US006446482B1

(12) United States Patent
Heskey et al.

(10) Patent No.: US 6,446,482 B1
(45) Date of Patent: Sep. 10, 2002

(54) BATTERY OPERATED HYDRAULIC COMPRESSION TOOL WITH RAPID RAM ADVANCE

(75) Inventors: George T. Heskey, Derry; John D. Lefavour, Litchfield; Gordon L. Steltzer, Goffstown, all of NH (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/953,757

(22) Filed: Sep. 17, 2001

(51) Int. Cl.[7] ..... B21D 7/06
(52) U.S. Cl. ..... 72/453.16; 72/453.02
(58) Field of Search ..... 72/453.02, 453.15, 72/453.16

(56) References Cited

U.S. PATENT DOCUMENTS

| | | | | |
|---|---|---|---|---|
| 4,226,110 A | | 10/1980 | Suganuma | 72/416 |
| 4,292,833 A | | 10/1981 | Lapp | 72/416 |
| 4,339,942 A | | 7/1982 | Svensson | 72/453.16 |
| 4,366,673 A | | 1/1983 | Lapp | 60/477 |
| 4,667,502 A | * | 5/1987 | Bush et al. | 72/453.15 |
| 4,796,461 A | | 1/1989 | Mead | 72/453.16 |
| 4,823,588 A | | 4/1989 | Bussereau et al. | 72/453.06 |
| 5,027,489 A | | 7/1991 | Johnston | 29/237 |
| 5,111,681 A | | 5/1992 | Yasui et al. | 72/453.03 |
| 5,134,989 A | | 8/1992 | Akahane | 125/40 |
| 5,195,354 A | | 3/1993 | Yasui et al. | 72/453.03 |
| 5,272,811 A | | 12/1993 | Armand | 30/228 |
| 5,442,992 A | | 8/1995 | Sanner et al. | 91/428 |
| 5,553,478 A | * | 9/1996 | Di Troia | 72/453.15 |
| D374,805 S | | 10/1996 | Moffatt et al. | D8/107 |
| 5,727,417 A | | 3/1998 | Moffatt et al. | 72/453.03 |
| 5,778,755 A | | 7/1998 | Boese | 91/399 |
| 5,802,908 A | | 9/1998 | Frenken | 72/409.16 |
| D408,242 S | | 4/1999 | Yamamoto | D8/61 |
| 5,924,536 A | | 7/1999 | Frenken | 192/56.1 |
| 5,934,136 A | | 8/1999 | Bracher et al. | 72/397 |
| 5,979,215 A | | 11/1999 | Lefavour et al. | 72/453.16 |
| 6,044,681 A | | 4/2000 | Frenken | 72/292 |
| 6,065,326 A | | 5/2000 | Frenken | 72/453.15 |
| 6,085,422 A | | 7/2000 | Hirabayashi | 30/122 |
| 6,206,663 B1 | | 3/2001 | Frenken | 417/549 |
| 6,227,030 B1 | | 5/2001 | Lefavour et al. | 72/416 |
| 6,230,542 B1 | | 5/2001 | Frenken | 72/456 |
| 6,276,186 B1 | * | 8/2001 | Frenken | 29/453.15 |

FOREIGN PATENT DOCUMENTS

| | | |
|---|---|---|
| JP | 06198574 A | 7/1994 |
| JP | 06262427 A | 9/1994 |
| JP | 08011066 A | 1/1996 |
| JP | 08321371 A | 3/1996 |
| JP | 09177707 A | 7/1997 |
| JP | 11179681 A | 7/1999 |
| JP | 11198057 A | 7/1999 |
| JP | 11198058 A | 7/1999 |
| JP | 11198062 A | 7/1999 |
| JP | 11251030 A | 9/1999 |
| JP | 2000117654 A | 4/2000 |

* cited by examiner

*Primary Examiner*—David Jones
(74) *Attorney, Agent, or Firm*—Harrington & Smith, LLP

(57) ABSTRACT

A battery operated hydraulic compression tool comprising a frame; a hydraulic fluid reservoir connected to the frame; an electric motor driven hydraulic pump connected to the hydraulic fluid reservoir; a ram movably connected to the frame; and a multi-speed ram advancement system for advancing the ram in at least two different rates of movement on the frame. The advancement system includes a rapid advance actuator located directly against the ram, and a hydraulic bypass system located between the pump and the ram for conduiting hydraulic fluid past the rapid advance actuator to the area of the frame holding the ram.

23 Claims, 3 Drawing Sheets

BATTERY OPERATED HYDRAULIC COMPRESSION TOOL WITH RAPID RAM ADVANCE

BACKGROUND OF THE INVENTION

1. Field of the Invention

The present invention relates to hydraulic compression tools and, more particularly, to a hydraulic compression tool having a rapid ram advance.

2. Prior Art

U.S. Pat. No. 5,979,215 discloses a hand operated hydraulic compression tool with a rapid ram advance. A mechanical actuator pushes against a rear end of the ram to move the ram at a first rate of movement until a predetermined resistance is encountered by the ram. After resistance is encountered, the hydraulic fluid pump moves the ram at a slower second rate of movement. One disadvantage of the tool is that it is relatively large. Battery operated hydraulic compression tools are known in the art, but they do not comprise a rapid ram advance.

U.S. Pat. No. 5,727,417 discloses a portable battery powered crimper. The crimper has a hydraulic pump with a rotating wobble plate connected to an electric motor. The wobble plate axially rotates to reciprocate hydraulic pistons. However, the crimper does not comprise a rapid ram advance.

There is a desire to provide a battery operated hydraulic crimping tool which has a rapid ram advancement system to increase the speed for crimping an electrical connector onto a conductor and for allowing a rechargeable battery to perform more crimping operations before having to be recharged. There is also a desire to provide a battery operated hydraulic crimping tool which can use a relatively low volume per revolution revolving hydraulic pump (to minimize cost, weight and size), but which can nonetheless maximize crimp speed.

SUMMARY OF THE INVENTION

In accordance with one aspect of the present invention, a battery operated hydraulic compression tool is provided comprising a frame; a hydraulic fluid reservoir connected to the frame; an electric motor driven hydraulic pump connected to the hydraulic fluid reservoir; a ram movably connected to the frame; and a multi-speed ram advancement system for advancing the ram in at least two different rates of movement on the frame. The advancement system comprises a rapid advance actuator located directly against the ram, a suction conduit located between the hydraulic fluid reservoir and an area of the frame holding the ram; and a hydraulic bypass system located between the pump and the ram for conduiting hydraulic fluid past the rapid advance actuator to the area of the frame holding the ram.

In accordance with another aspect of the present invention, a battery operated hydraulic compression tool is provided comprising a frame; a hydraulic fluid reservoir connected to the frame; an electric motor driven hydraulic pump connected to the hydraulic fluid reservoir; a ram movably connected to the frame; a hydraulic fluid conduit system in the frame between the pump and the ram; and a mechanical actuator provided in the conduit system for contacting and pushing against the rear end of the ram. The conduit system is adapted to conduit hydraulic fluid from the pump against both the rear end of the ram and a rear end of the mechanical actuator.

In accordance with one method of the present invention, a method of advancing a ram in a hydraulic compression tool is provided comprising steps of actuating an electric motor in the tool to actuate a hydraulic pump of the tool to move the ram relative to a frame of the tool at a first rate of movement comprising hydraulic fluid pushing against a first pushing surface connected to the ram to push the ram forward; and automatically switching movement of the ram to a second slower rate of movement when the ram encounters a predetermined resistance to forward movement on the frame, wherein the step of automatically switching comprises a bypass valve in the tool opening to allow hydraulic fluid to be pumped by the pump into an area adjacent a rear end of the ram.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
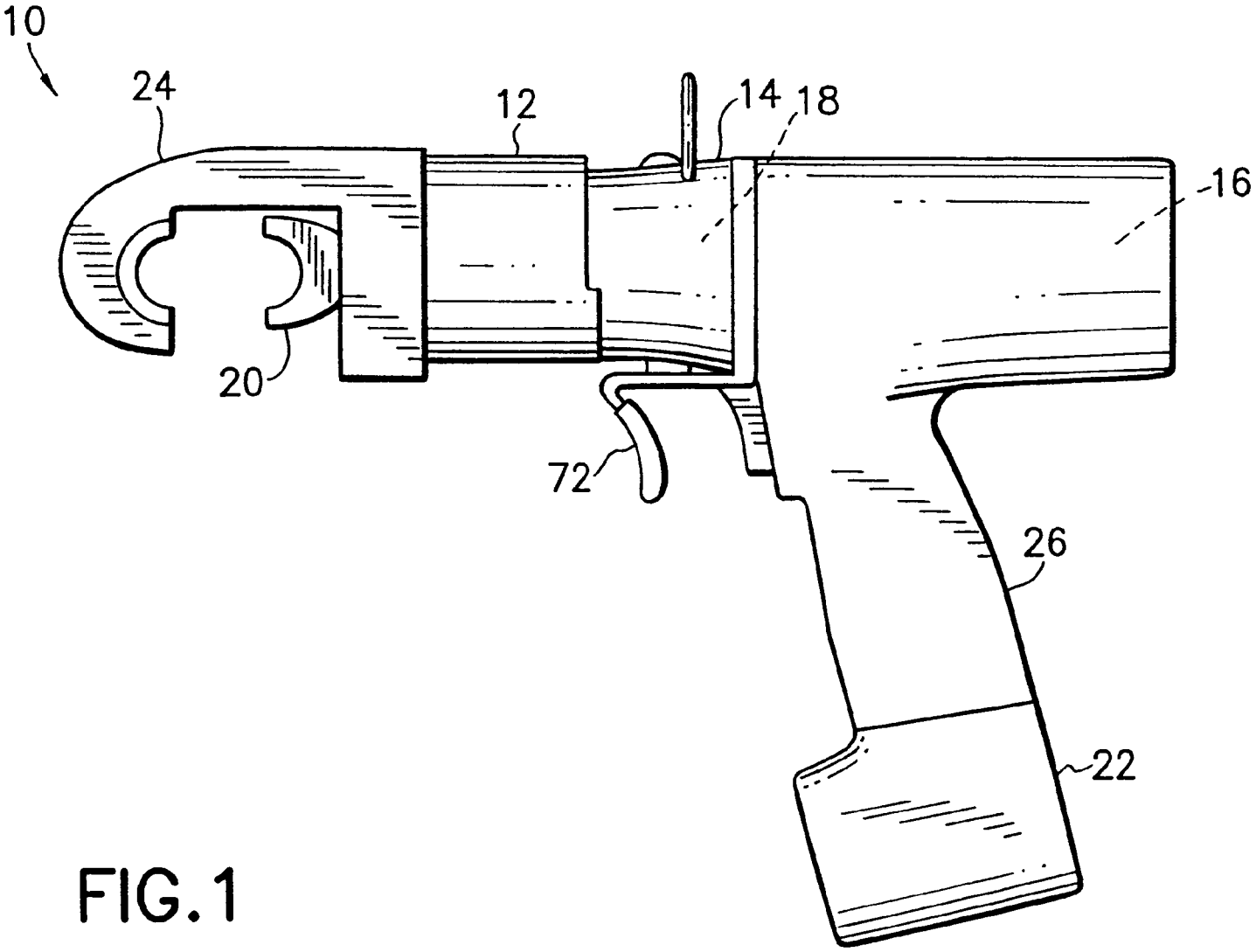
FIG. 1 is a side elevational view of a battery operated hydraulic compression tool incorporating features of the present invention.

Referring to FIG. 1, there is shown a side elevational view of a battery operated hydraulic tool 10 incorporating features of the present invention. Although the present invention will be described with reference to the single embodiment shown in the drawings, it should be understood that the present invention can be embodied in many alternate forms of embodiments. In addition, any suitable size, shape or type of elements or materials could be used.

The tool 10, in the embodiment shown, is a compression tool for crimping an electrical connector onto an electrical conductor. However, in alternate embodiments, features of the present invention could be incorporated into any suitable type of hydraulic tool. The tool 10 generally comprises a frame 12, a hydraulic fluid reservoir 14, an electric motor 16, a hydraulic pump 18, a movable ram 20 and a battery 22.

Figure 2:
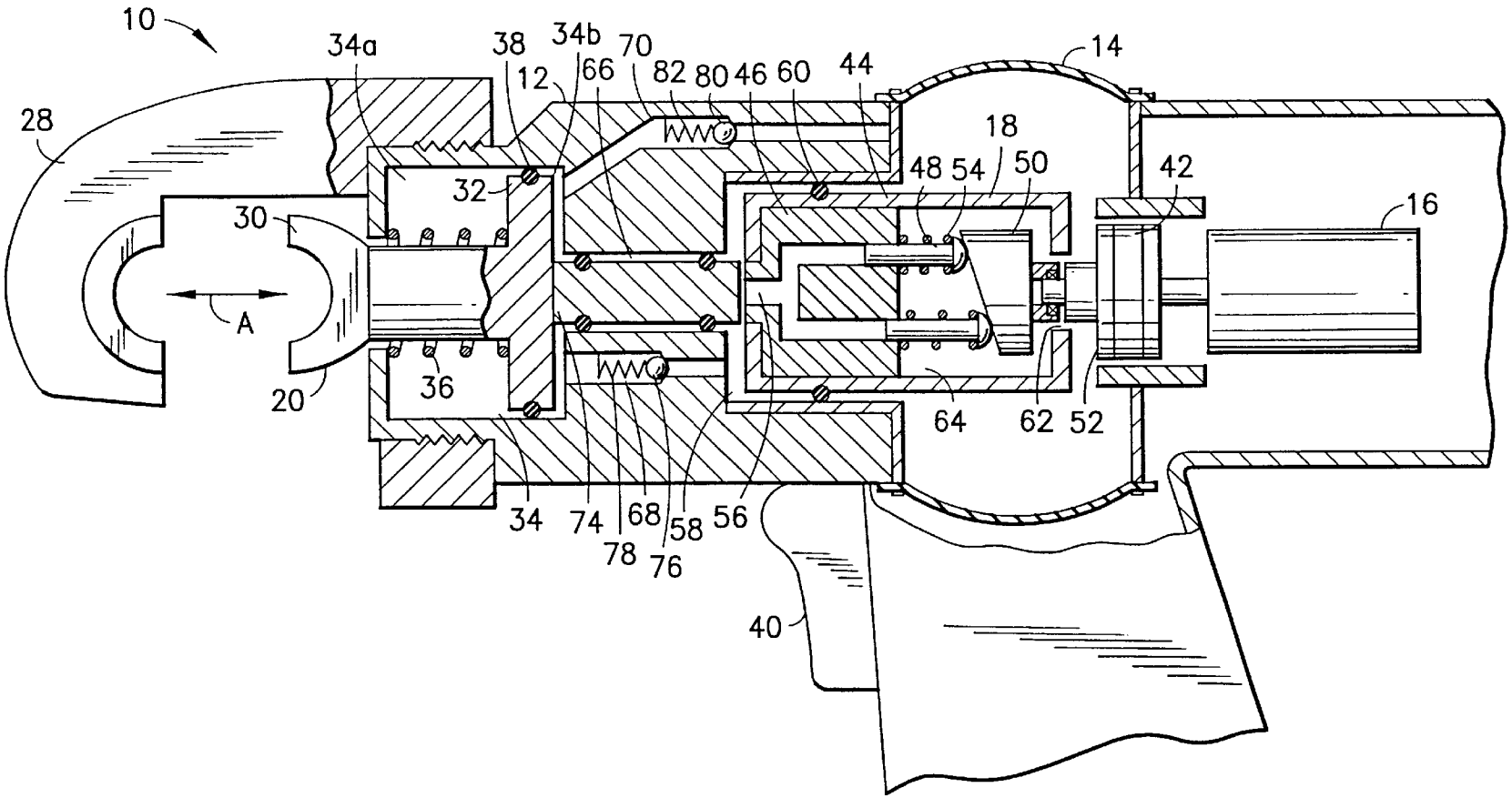
FIG. 2 is a partial cross sectional view of a portion of the tool shown in FIG. 1 with the ram at a home retracted position.

Referring also to FIG. 2, the frame 12 comprises a compression head section 24 and a handle section 26. In an alternate embodiment, the frame could have any suitable number or type of sections. The battery 22 is preferably a rechargeable battery and is preferably removably connected to the handle section 26. However, in alternate embodiments, any suitable type of battery or electrical power supply could be provided for the motor 16. In addition, the battery might not be removable.

The ram 20 is movably connected to the frame 12. A portion 28 of the frame is located directly opposite the front end of the ram 20 to function as an anvil section. The portion 28 and front end 30 of the ram 20 are preferably adapted to removably receive electrical connector crimping dies therein. However, in alternate embodiments, the portion 28 and ram 20 might be dieless crimping members. In another alternate embodiment, the portion 28 and/or the ram 20 could comprise cutting surfaces.

The rear end 32 of the ram 20 is located in a chamber 34 of the frame 12. FIG. 2 shows the ram 20 in a retracted home position relative to the frame 12. A spring 36 is provided to bias the ram 20 at its home position. The ram 20 includes a seal 38 on its rear end 32 which makes a sealing engagement with the frame 12. The rear end 32 and seal 38 divide the chamber 34 into a front section 34*a* and a rear section 34*b*. The ram 20 is adapted to longitudinally slide relative to the frame 12 as indicated by arrow A. However, in alternate embodiments, the tool could comprise any suitable type of ram.

The electric motor 16 is preferably a small DC motor. However, in an alternate embodiment, the tool could comprise any suitable type of electric motor. The motor 16 is electrically connectable to the battery 22 when a user actuates a trigger switch 40. However, in an alternate embodiment, any suitable means for actuating the motor 16 could be provided. The motor 16 is connected to the pump 18 by a coupling 42. Coupling 42 could be a reduction gear assembly. Alternatively, the coupling 42 could be a direct coupling.

The hydraulic pump 18 in the embodiment shown is a fixed displacement axial piston pump. However, in alternate embodiments, any suitable type of hydraulic pump could be used. In a preferred embodiment, the pump 18 is a cartridge style pump having an outer frame 44, an inner frame 46, pistons 48, a wobble member 50 and a drive member 52. The front end of the pump 18 is fixedly located in an area 58 of the frame 12. A seal 60 is provided between the outer frame 44 and the frame 12.

The drive member 52 extends out of the rear end of the outer frame 44 and is connected to the coupling 42. The front end of the drive member 52 is connected to the wobble member 50. The pistons 48 are located in channels of the inner frame 46 and extend from the rear end of the inner frame 46. The pump includes springs 54 which bias the pistons 48 against the front face of the wobble member 50. The inner frame 46 has a hydraulic channel outlet 56 at the front end of the outer frame 44.

The pistons 48 are adapted to reciprocally move in and out of the channels of the inner frame 46. More specifically, when the wobble member 50 is axially rotated by the motor 16, the pistons 48 are reciprocated in forward and rearward directions. Forward movement of the pistons 48 pushes hydraulic fluid forward. Hydraulic fluid pumped forward by the pistons 48 can be pushed out of the outlet 56 into the front end of the area 58. The seal 60 prevents the hydraulic fluid from inadvertently returning back to the reservoir 14.

The hydraulic fluid reservoir 14, in the embodiment shown, surrounds the rear end of the pump 18. This type of coaxial design helps to keep the length of the tool 10 relatively small, thus, helping to reduce the size and weight of the tool. In a preferred embodiment, the hydraulic fluid reservoir 14 as a collapsible bladder (not shown) which can collapse as hydraulic fluid is pushed by the pump 18 out of the reservoir 14. However, in an alternate embodiment, the tool could comprise any suitable type of hydraulic fluid reservoir. The hydraulic fluid is preferably oil, but any suitable type of hydraulic fluid could be provided. The outer frame 44 preferably has an opening 62 therein to allow hydraulic fluid to pass from the reservoir 14 into the area 64 for subsequent entry and pumping by the pistons 48.

The tool 10 comprises a hydraulic fluid conduit system for delivering hydraulic fluid from the pump 18 and the reservoir 14 to the rear section 34*b* of the ram chamber 34, and back to the reservoir 14. In the embodiment shown, the conduit system includes the front section of the area 58, a mechanical actuator conduit 66, a pump bypass conduit 68, a suction conduit 70, and a hydraulic fluid return conduit (not shown). The hydraulic fluid return conduit extends from the rear section 34*b* of the chamber 34 back to the reservoir 14. In a preferred embodiment, the hydraulic fluid return conduit comprises a valve (not shown) which can be moved to an open position by an user actuated member 72 (see FIG. 1). However, any suitable type of hydraulic pressure release mechanism could be used.

The tool 10 comprises a shuttle member 74 which can function as a rapid advance actuator or mechanical actuator. The actuator 74 is longitudinally slidably located in the mechanical actuator conduit 66. Seals are provided between the actuator 74 and the frame 12 to form a seal between the area 58 and the rear section 34*b*. The actuator 74 is a separate member from the ram 20. However, a front end of the actuator 74 is adapted to directly contact the ram 20 for allowing the actuator 74 to push the ram 20 forward as further understood below. The rear end of the actuator 74 is located at the front end of the area 58. Thus, hydraulic fluid pumped by the pump 18 into the front end of the area 58 is in direct communication with the rear end of the actuator 74.

The pump bypass conduit 68 extends from the area 58 to the section 34*b*. The pump bypass conduit 68 includes a ball 76 and spring 78 located therein to form a check valve. When hydraulic pressure in the front of the area 58 is sufficiently large enough to compress the spring 78 hydraulic fluid can flow through the conduit 68 from the area 58 to the section 34*b*. In an alternate embodiment, the bypass conduit 68 and bypass valve formed by the ball 76 and spring 78 could be formed as an assembly inside the actuator 74.

The suction conduit 70 extends from the reservoir 14 to the rear section 34*b*. The suction conduit 70 includes a ball 80 and a spring 82 located therein to form a check valve. When suction or reduced pressure in the rear section 34*b* is sufficiently large enough to move the ball 80 and compress the spring 82, hydraulic fluid from the reservoir 14 can be sucked through the suction conduit 70 directly into the rear section 34*b*. In an alternate embodiment, any suitable type of system for delivering hydraulic fluid to the rear section 34*b*, when the ram 20 is being advanced by the actuator 74 at the first rate of movement, could be provided.

When the ram 20 is at its home retracted position and a user depresses the trigger switch 40, the motor 16 rotates the coupling 42 to thereby rotate the wobble member 50. This causes the pistons 48 to move in and out relative to the inner frame 46 and thereby pump hydraulic fluid out the outlet 56 into the front of the area 58. The hydraulic fluid presses against the rear end of the actuator 74. The hydraulic fluid also presses against the ball 76. However the pressure of the hydraulic fluid is insufficient to move the ball 76 away from its valve seat on the frame 12.

With the hydraulic fluid pressing against the rear end of the actuator 74, the actuator 74 is moved forward at a first rate of movement in the mechanical actuator conduit 66. Because the actuator 74 is located against the ram 20, movement of the actuator 74 forward directly pushes against the ram 20 and moves the ram 20 forward at the first rate of movement. As the ram 20 is moved forward by the actuator 74, a vacuum or reduced pressure is generated in the rear section 34*b* of the chamber 34 by the forward movement of the ram's rear section 32. This vacuum or reduced pressure acts on the ball 80 to pull the ball off its valve seat with the spring 82 being compressed. The vacuum or reduce pressure then sucks hydraulic fluid through the suction conduit 70 from the hydraulic reservoir 14 into the rear section 34*b*.

Figure 3:
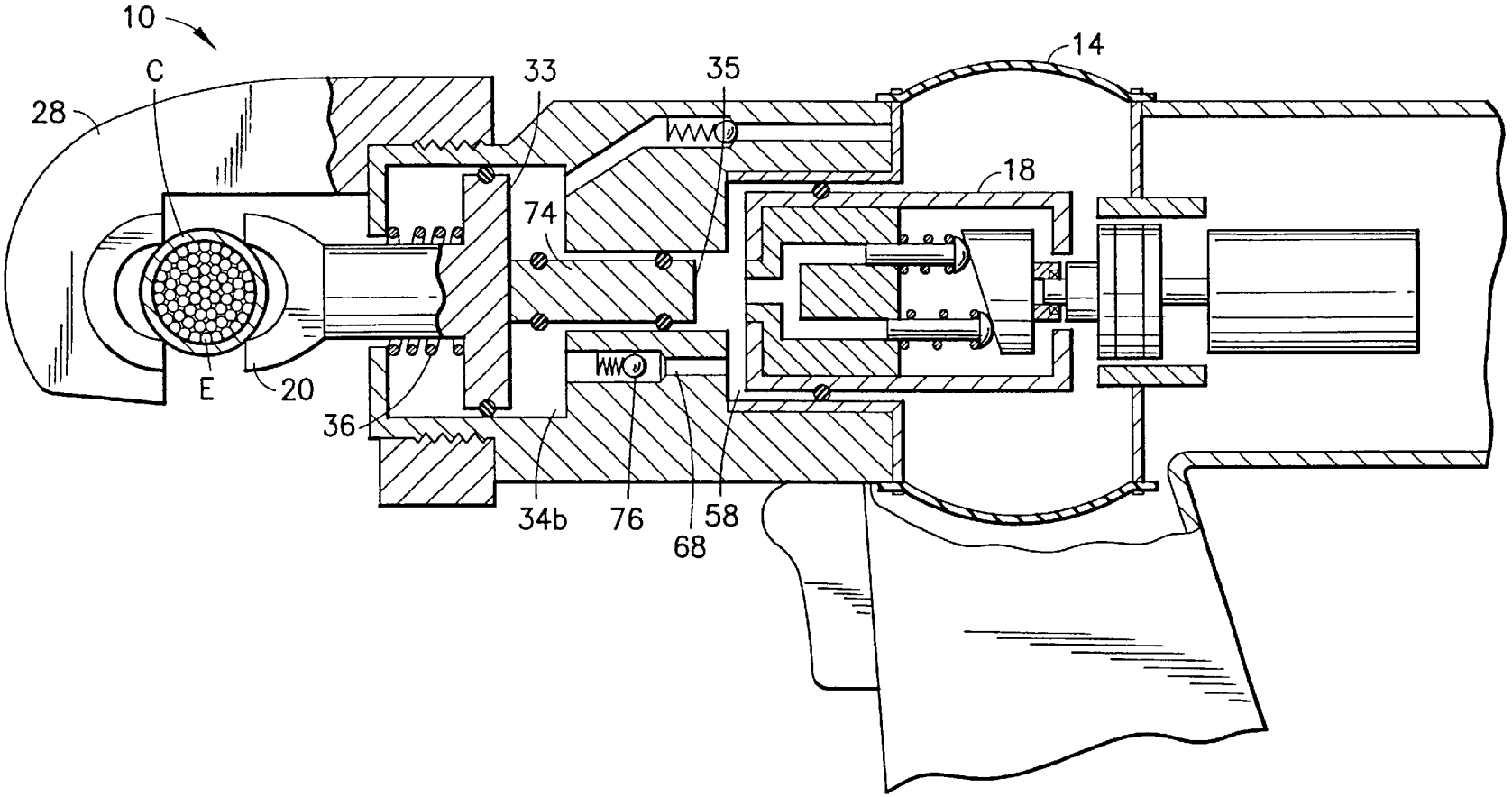
FIG. 3 is a partial cross sectional view as in FIG. 2 with the ram at an extended forward position.

Referring also to FIG. 3, the tool 10 it is shown with the ram 20 advanced into contact with an electrical connector C to sandwich the connector between the section 28 and the ram 20. When this occurs, the connector C is about to be compressed or crimped between the section 28 and ram 20 onto the electrical conductor E located inside the connector C. When the ram 20 meets a predetermined resistance to its forward movement by contact with the connector C, a predetermined hydraulic pressure is generated in the front section of area 58. The valve formed in the pump bypass conduit 68 is adapted to open at this predetermined hydraulic pressure. Thus, the ball 76 moves away from its valve seat and hydraulic fluid can now flow through the pump bypass conduit 68 from the front section of the area 58 into the rear section 34*b* of the ram chamber 34.

Because the area of the surface 33 at the rear end 32 of the ram 20 is larger than the surface 35 at the rear end of the actuator 74, and because the pump 18 has not changed its speed, the ram 20 is moved forward at a second slower rate of movement. The actuator 74 continues to move forward with the ram 20, but it is not the primary motive force. Instead, the ram 20 is primarily moved forward by the hydraulic pressure in the rear section 34*b* of the chamber 34. Although the ram 20 moves forward at a slower rate of movement, the size of the area on the surface 33 allows the hydraulic pressure in the rear section 34*b* to generate a relatively larger force against the electrical connector C (Force=Pressure×Area; F=P·A) to thereby crimp or compress the electrical connector onto the electrical conductor E.

Even though the pump 18 can have a relatively constant speed, the ram 20 can move at two different speeds because of the multi-speed ram advancement system described above. The multi-speed ram advancement system automatically switches from the first relatively fast speed movement of the ram to the second relatively slower movement of the ram When the ram encounters a predetermined resistance to forward movement. The tool 10 preferably comprises a pressure relief valve when pressure in the rear section 34*b* of the chamber 34 reaches a predetermined pressure, such as 7000-10000 psi for example. However, in alternate embodiments, any suitable type of pressure relief system could be provided. After compression or crimping of the connector C is complete, the user can release the trigger switch 40 and actuate the user actuated member 72 to allow hydraulic fluid in the rear end section 34*b* to return to the reservoir 14 with the spring 36 returning the ram 20 to its rear home position.

The present invention provides a battery operated hydraulic compression tool which has a much faster crimp speed than conventional battery operated hydraulic compression tools. The present invention can use a cartridge style of hydraulic pump to minimize cost, weight and size of the tool. Even though the cartridge style pump has a relatively low volume-to-revolution hydraulic fluid output, the present invention allows use of this cartridge style pump by use of a rapid ram advancement system, to provide a relatively fast ram movement speed from the retracted home position shown in FIG. 2 to the connector contact position shown in FIG. 3.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A battery operated hydraulic compression tool comprising:

a frame;

a hydraulic fluid reservoir connected to the frame;

an electric motor driven hydraulic pump connected to the hydraulic fluid reservoir;

a ram movably connected to the frame; and a multi-speed ram advancement system for advancing the ram in at least two different rates of movement on the frame, the advancement system comprising:

a rapid advance actuator located directly against the ram, hydraulic fluid from the pump being pumped against the rapid advance actuator;

a suction conduit located between the hydraulic fluid reservoir and an area of the frame holding the ram; and a hydraulic bypass system located between the pump and the ram for conduiting hydraulic fluid past the rapid advance actuator to an area of the frame holding the ram.

2. A battery operated hydraulic compression tool as in claim 1 wherein the pump comprises an axially rotatable wobble member and longitudinally slidable pistons biased against the wobble member.

3. A battery operated hydraulic compression tool as in claim 2 further comprising an electric motor connected to the wobble member for axially rotating the wobble member.

4. A battery operated hydraulic compression tool as in claim 3 further comprising a battery removably connected to the electric motor.

5. A battery operated hydraulic compression tool as in claim 1 wherein the rapid advance actuator comprises a shuttle member longitudinally slidably located inside a portion of the frame.

6. A battery operated hydraulic compression tool as in claim 5 wherein the rapid advance actuator comprises at least one seal located between the shuttle member and the frame.

7. A battery operated hydraulic compression tool as in claim 1 wherein the hydraulic bypass system comprises a conduit located between the pump and the area of the frame holding the ram, and a bypass valve located in the conduit.

8. A battery operated hydraulic compression tool as in claim 1 wherein the suction conduit comprises a check valve therein for limiting the flow of hydraulic fluid to one direction through the suction conduit.

9. A battery operated hydraulic compression tool as in claim 1 wherein the hydraulic fluid reservoir at least partially surrounds a portion of the pump.

10. A battery operated hydraulic compression tool comprising:

a frame;

a hydraulic fluid reservoir connected to the frame;

an electric motor driven hydraulic pump connected to the hydraulic fluid reservoir;

a ram movably connected to the frame;

a hydraulic fluid conduit system in the frame between the pump and the ram; and a mechanical actuator provided in the conduit system for contacting and pushing against a rear end of the ram, wherein the conduit system is adapted to conduit hydraulic fluid from the pump against both the rear end of the ram and a rear end of the mechanical actuator.

11. A battery operated hydraulic compression tool as in claim 10 wherein the pump comprises an axially rotatable wobble member and longitudinally slidable pistons biased against the wobble member.

12. A battery operated hydraulic compression tool as in claim 11 further comprising an electric motor connected to the wobble member for axially rotating the wobble member.

13. A battery operated hydraulic compression tool as in claim 12 further comprising a battery removably connected to the electric motor.

14. A battery operated hydraulic compression tool as in claim 10 wherein the mechanical actuator is longitudinally slidably located inside a portion of the frame.

15. A battery operated hydraulic compression tool as in claim 10 wherein the hydraulic fluid conduit system comprises a hydraulic bypass system having a conduit located between the pump and an area of the frame holding the ram, and a bypass valve located in the conduit.

16. A battery operated hydraulic compression tool as in claim 10 wherein the hydraulic fluid conduit system has a suction conduit between the hydraulic fluid reservoir and the ram with a check valve therein for limiting the flow of hydraulic fluid to one direction through the suction conduit.

17. A battery operated hydraulic compression tool as in claim 10 wherein the hydraulic fluid reservoir at least partially surrounds a portion of the pump.

18. A method of advancing a ram in a hydraulic compression tool comprising steps of:

actuating an electric motor in the tool to actuate a hydraulic pump of the tool to move the ram relative to a frame of the tool at a first rate of movement comprising hydraulic fluid pushing against a first pushing surface connected to the ram to push the ram forward; and automatically switching movement of the ram to a second slower rate of movement when the ram encounters a predetermined resistance to forward movement on the frame, wherein the step of automatically switching comprises a bypass valve in the tool opening to allow hydraulic fluid to be pumped by the pump into an area having a second relatively larger pushing surface for pushing the ram forward at the second slower rate.

19. A method as in claim 18 wherein the hydraulic pump comprises a rotatable wobble member connected to the electric motor and a reciprocating piston member biased against the wobble member, and wherein rotation of the wobble member by the electric motor causes the piston member to reciprocate and push hydraulic fluid out of the pump.

20. A method as in claim 18 wherein the first pushing surface is located on a rapid advance actuator located against a rear end of the ram, and wherein the rapid advance actuator physically pushes the ram forward during the first rate of movement.

21. A method as in claim 20 further comprising sucking hydraulic fluid from a hydraulic fluid reservoir directly into an area behind the ram when the ram is pushed forward by the rapid advance actuator during the first rate of movement.

22. A hydraulic compression tool comprising:

a frame having a hydraulic fluid conduit system therein;

an electric motor driven hydraulic pump connected to the hydraulic fluid conduit system of the frame;

a ram movably connected to the frame; and a ram advancement system for advancing the ram on the frame, the advancement system comprising:

an actuator located against the ram, hydraulic fluid from the pump being pumped through the hydraulic fluid conduit system against the actuator; and a hydraulic bypass system located between the pump and the ram for conduiting hydraulic fluid through the hydraulic fluid conduit system past the rapid advance actuator to an area of the frame holding the ram.

23. A hydraulic compression tool comprising:

a frame;

a ram movably connected to the frame;

a hydraulic fluid conduit system in the frame;

an electric motor driven hydraulic pump connected to the hydraulic fluid conduit system of the frame; and a mechanical actuator provided in the conduit system for contacting and pushing against a rear end of the ram, wherein the conduit system is adapted to conduit hydraulic fluid against both the rear end of the ram and a rear end of the mechanical actuator.

* * * * *